US011710902B2

(12) United States Patent
Liu

(10) Patent No.: US 11,710,902 B2
(45) Date of Patent: Jul. 25, 2023

(54) DUAL-POLARIZED MAGNETO-ELECTRIC ANTENNA ARRAY

(71) Applicant: International Business Machines Corporation, Armonk, NY (US)

(72) Inventor: Duixian Liu, Scarsdale, NY (US)

(73) Assignee: International Business Machines Corporation, Armonk, NY (US)

( * ) Notice: Subject to any disclaimer, the term of this patent is extended or adjusted under 35 U.S.C. 154(b) by 230 days.

(21) Appl. No.: 17/171,029

(22) Filed: Feb. 9, 2021

(65) Prior Publication Data

US 2022/0255230 A1 Aug. 11, 2022

(51) Int. Cl.

*H01Q 9/04* (2006.01)
*H01Q 1/38* (2006.01)
*H01Q 9/28* (2006.01)

(52) U.S. Cl.

CPC ..... *H01Q 9/0414* (2013.01); *H01Q 1/38* (2013.01); *H01Q 9/045* (2013.01); *H01Q 9/0442* (2013.01); *H01Q 9/28* (2013.01)

(58) Field of Classification Search

CPC ..... H01Q 9/0414; H01Q 1/38; H01Q 9/0442; H01Q 9/045; H01Q 9/28

See application file for complete search history.

(56) References Cited

U.S. PATENT DOCUMENTS 7,843,389 B2 11/2010 Luk et al.
7,852,281 B2 12/2010 Choudhury
8,816,929 B2 8/2014 Kam et al.
9,196,951 B2 11/2015 Baks et al.
9,343,817 B2 5/2016 Pan
9,368,873 B2 6/2016 Myszne et al.
(Continued)

FOREIGN PATENT DOCUMENTS

CN 103187620 B 7/2015
CN 108879114 A 11/2018
(Continued)

OTHER PUBLICATIONS

Clavin, "An improved element for use in array antennas," 5th European Microwave Conference, pp. 97-101, Sep. 1-4, 1975.
(Continued)

*Primary Examiner* — David E Lotter
(74) *Attorney, Agent, or Firm* — Jeffrey M. Ingalls

(57) ABSTRACT

A package structure is provided that includes a planar core structure comprising a first side and a second side opposite the first side. The package structure also includes an antenna structure disposed on the first side of the planar core structure. The antenna structure comprises a plurality of first laminated layers, each first laminated layer comprising a first patterned conductive layer formed on a first insulating layer, an antenna formed on one or more first patterned conductive layers of the first laminated layers, the antenna including at least one L-shaped structure. The package structure also includes an interface structure disposed on the second side of the planar core structure, and an antenna feed line structure formed in, and routed through, the interface structure and the planar core structure, wherein the antenna feed line structure is not connected to the planar antenna.

25 Claims, 8 Drawing Sheets

(56) References Cited

U.S. PATENT DOCUMENTS

| | | | | |
|---|---|---|---|---|
| 9,413,079 | B2 | 8/2016 | Kamgaing et al. | |
| 9,531,087 | B2 | 12/2016 | Ying | |
| 9,537,224 | B2 | 1/2017 | Friedman et al. | |
| 9,620,464 | B2 | 4/2017 | Baks et al. | |
| 10,103,450 | B2 | 10/2018 | Dang et al. | |
| 10,203,159 | B2 | 2/2019 | Zager et al. | |
| 10,263,336 | B1 | 4/2019 | Wong et al. | |
| 10,367,266 | B2 | 7/2019 | Wong et al. | |
| 10,381,880 | B2 | 8/2019 | Leabman et al. | |
| 10,594,019 | B2 | 3/2020 | Baks et al. | |
| 2014/0145883 | A1* | 5/2014 | Baks | H01L 23/66 343/700 MS |
| 2016/0049723 | A1 | 2/2016 | Baks et al. | |
| 2016/0056544 | A1* | 2/2016 | Garcia | H01Q 9/0407 343/725 |
| 2017/0062908 | A1 | 3/2017 | Sanderovich et al. | |
| 2017/0237180 | A1 | 8/2017 | Corman et al. | |
| 2018/0159203 | A1 | 6/2018 | Baks | |
| 2018/0337148 | A1 | 11/2018 | Baek | |
| 2019/0191597 | A1 | 6/2019 | Han et al. | |
| 2019/0319338 | A1 | 10/2019 | Gu et al. | |

FOREIGN PATENT DOCUMENTS

| | | | |
|---|---|---|---|
| CN | 110534924 | A | 12/2019 |
| CN | 109244642 | B | 11/2020 |
| JP | 2003332830 | A | 11/2003 |
| WO | 2017121477 | A1 | 7/2017 |

OTHER PUBLICATIONS

Ng et al., "60 GHz plated through hole printed magneto-electric dipole antenna," IEEE Trans on antennas and propgation, vol. 60, No. 7, pp. 3129-3136, Jul. 2012.

Wu et al., "A Broadband Dual-Polarized Magneto-Electric Dipole Antenna With Simple Feeds", IEEE Antennas and Wireless Propagation Letters, vol. 8, pp. 60-63, 2009.

Xue et al., "A Differentially-Driven Dual-Polarized Magneto-Electric Dipole Antenna," IEEE Trans on Antennas and Propagation, vol. 61, No. 1, pp. 425-430, Jan. 2013.

Li et al., "A Ka-Band Wideband Dual-Polarized Magnetoelectric Dipole Antenna Array on LTCC," IEEE Transactions on Antennas and Propagation, vol. 68, No. 6, Jun. 2020, 6 pages.

International Search Report and Written Opinion for Application PCT/IB2021/062325, dated Mar. 24, 2022, 7 pages.

* cited by examiner

Antenna impedance match and port coupling

DUAL-POLARIZED MAGNETO-ELECTRIC ANTENNA ARRAY

BACKGROUND

The present disclosure relates generally to wireless communication package structures, and, in particular, to techniques for packaging antenna structures with semiconductor RFIC (radio frequency integrated circuit) chips to form compact integrated radio/wireless communications systems for millimeter wave (mm Wave) applications. Specifically, the present disclosure relates to dual-polarized magneto-electric antenna array structures for RFIC package applications.

When constructing wireless communications package structures with integrated antennas, it may be desirable to implement package designs that provide proper antenna characteristics (e.g., high efficiency, wide bandwidth, good radiation characteristics, etc.), while providing low cost and reliable package solutions. The integration process requires the use of high-precision fabrication technologies so that fine features can be implemented in the package structure. Conventional solutions are typically implemented using complex and costly packaging technologies, which are lossy and/or utilize high dielectric constant materials. For consumer applications, high performance package designs with integrated antennas are not typically required. However, for industrial applications (e.g., 5G cell tower applications), high performance antenna packages are needed and typically require large phased arrays of antennas. The ability to design high performance packages with phased array antennas is not trivial for millimeter wave operating frequencies and higher.

One type of antenna design is known as magneto-electric dipole (MED) antenna. In general, a MED antenna includes a magnetic dipole and an electric dipole. By exciting the complementary dipoles with suitable amplitudes and phases simultaneously, the antenna is able to produce good radiation characteristics over a wide frequency band. MED antennas may be suitable for certain mobile cellular networks.

Certain antenna designs do not consider the RFIC package environment, such as having many metal layers and any metal layer metal fill requirements. Also, certain phased array applications may require $\lambda/2$ wavelength spacing requirements. In certain examples, the antenna performance may deteriorate in an Antenna-in-Package (AiP) environment.

SUMMARY

Embodiments of the present disclosure relate to a package structure that includes a planar core structure comprising a first side and a second side opposite the first side. The package structure also includes an antenna structure disposed on the first side of the planar core structure. The antenna structure comprises a plurality of first laminated layers, each first laminated layer comprising a first patterned conductive layer formed on a first insulating layer, an antenna formed on one or more first patterned conductive layers of the first laminated layers, the antenna including at least one L-shaped structure. The package structure also includes an interface structure disposed on the second side of the planar core structure, and an antenna feed line structure formed in, and routed through, the interface structure and the planar core structure, wherein the antenna feed line structure is not connected to the planar antenna. This may allow for high performance phased array antenna design for wide bandwidth, high horizontal and vertical port isolation, and stable gain.

In certain embodiments, the antenna includes four of the L-shaped structures. This may allow for tuning of the high performance phased array antenna design by altering certain dimensions of the L-shaped structures.

In certain embodiments, the L-shaped structures are arranged in a symmetrical manner with corners of the L-shaped structures facing inward. This may further allow for tuning of the high performance phased array antenna design by altering certain dimensions of the L-shaped structures.

In certain embodiments, the package structure further comprises a cage wall structure in the antenna structure, the cage wall surrounding the antenna. In certain embodiments, the cage wall structure is electrically connected to the L-shaped structure through a first ground plane layer of the core structure. In certain embodiments, the cage wall structure includes a plurality of conductive grounded rings that extend vertically through the antenna structure. The cage wall structure (or grounded cage wall) may enable enhanced antenna performance in many high precision package processes.

In certain embodiments, an apparatus is provided including a package structure comprising a planar core structure comprising a first side and a second side opposite the first side. The package structure also includes an antenna structure disposed on the first side of the planar core structure. The antenna structure comprises a plurality of first laminated layers, each first laminated layer comprising a first patterned conductive layer formed on a first insulating layer, an antenna formed on one or more first patterned conductive layers of the first laminated layers, the antenna including at least one L-shaped structure. The package structure also includes an interface structure disposed on the second side of the planar core structure, and an antenna feed line structure formed in, and routed through, the interface structure and the planar core structure, wherein the antenna feed line structure is not connected to the planar antenna. This may allow for high performance phased array antenna design for wide bandwidth, high horizontal and vertical port isolation, and stable gain. The apparatus also includes an RFIC (radio frequency integrated circuit) chip comprising a semiconductor substrate having an active surface and an inactive surface, and a BEOL (back end of line) structure formed on the active surface of the semiconductor substrate, wherein the RFIC chip is mounted to the package structure by connecting the BEOL structure of the RFIC chip to contact pads of the interface structure. This may allow for high performance phased array antenna design for wide bandwidth, high horizontal and vertical port isolation, and stable gain.

In certain embodiments, the antenna of the apparatus includes four of the L-shaped structures. This may allow for tuning of the high performance phased array antenna design by altering certain dimensions of the L-shaped structures.

In certain embodiments of the apparatus, the L-shaped structures are arranged in a symmetrical manner with corners of the L-shaped structures facing inward. This may further allow for tuning of the high performance phased array antenna design by altering certain dimensions of the L-shaped structures.

In certain embodiments of the apparatus, the package structure further comprises a cage wall structure in the antenna structure, the cage wall surrounding the antenna. In certain embodiments, the cage wall structure is electrically connected to the L-shaped structure through a first ground plane layer of the core structure. In certain embodiments, the cage wall structure includes a plurality of conductive grounded rings that extend vertically through the antenna structure. The cage wall structure (or grounded cage wall) may enable enhanced antenna performance in many high precision package processes.

Embodiments of the present disclosure relate to a method of manufacturing a package structure, the method include forming a planar core structure comprising a first side and a second side opposite the first side. The method also includes forming an antenna structure on the first side of the planar core structure, the antenna structure comprising a plurality of first laminated layers, each first laminated layer comprising a first patterned conductive layer formed on a first insulating layer, an antenna formed on one or more first patterned conductive layers of the first laminated layers, the antenna including at least one L-shaped structure. The method also includes forming an interface structure on the second side of the planar core structure. The method also includes forming an antenna feed line structure in, and routed through, the interface structure and the planar core structure, wherein the antenna feed line structure is not connected to the planar antenna. This may allow for high performance phased array antenna design for wide bandwidth, high horizontal and vertical port isolation, and stable gain.

In certain embodiments of the method of manufacturing the package structure, the antenna of the apparatus includes four of the L-shaped structures. This may allow for tuning of the high performance phased array antenna design by altering certain dimensions of the L-shaped structures.

In certain embodiments of the method of manufacturing the package structure, the L-shaped structures are arranged in a symmetrical manner with corners of the L-shaped structures facing inward. This may further allow for tuning of the high performance phased array antenna design by altering certain dimensions of the L-shaped structures.

In certain embodiments of the method of manufacturing the package structure, the package structure further comprises a cage wall structure in the antenna structure, the cage wall surrounding the antenna. In certain embodiments, the cage wall structure is electrically connected to the L-shaped structure through a first ground plane layer of the core structure. In certain embodiments, the cage wall structure includes a plurality of conductive grounded rings that extend vertically through the antenna structure. The cage wall structure (or grounded cage wall) may enable enhanced antenna performance in many high precision package processes.

It should be noted that the exemplary embodiments are described with reference to different subject-matters. In particular, some embodiments are described with reference to method type claims whereas other embodiments have been described with reference to apparatus type claims. However, a person skilled in the art will gather from the above and the following description that, unless otherwise notified, in addition to any combination of features belonging to one type of subject-matter, also any combination between features relating to different subject-matters, in particular, between features of the method type claims, and features of the apparatus type claims, is considered as to be described within this document.

These and other features and advantages will become apparent from the following detailed description of illustrative embodiments thereof, which is to be read in connection with the accompanying drawings.

The above summary is not intended to describe each illustrated embodiment or every implementation of the present disclosure.

BRIEF DESCRIPTION OF THE DRAWINGS

The drawings included in the present application are incorporated into, and form part of, the specification. They illustrate embodiments of the present disclosure and, along with the description, explain the principles of the disclosure. The drawings are only illustrative of certain embodiments and do not limit the disclosure.

DETAILED DESCRIPTION

Embodiments will now be discussed in further detail with regard to wireless communications package structures and, in particular, to techniques for packaging antenna structures with semiconductor RFIC chips to form compact integrated radio/wireless communications systems with high-performance integrated antenna systems (e.g., phased array antenna system).

The present embodiments provide antenna array in package implementations for the magneto-electric dipole (MED) antenna. The present embodiments may also include one or more of the following features: an L-shaped patch structure for antenna performance and tunability; a cavity for the antenna to reduce antenna coupling and manufacturability; and an antenna feed line technique for antenna impedance matching and feed line routine, which may be helpful for array applications The phased array antenna design of the present embodiments may be based on the magneto-electric dipole (MED) antenna concept. These embodiments may improve antenna performance such as having a wide bandwidth, high port isolation, and stable gain. The present embodiments may be especially suitable for Antenna-in-Package (AiP) applications that fully utilize the package environment. The present embodiments may be used in high performance and low cost phased arrays in a package environment.

It is to be understood that the various layers and/or components shown in the accompanying drawings are not drawn to scale, and that one or more layers and/or components of a type commonly used in constructing wireless communications packages with integrated antennas and RFIC chips may not be explicitly shown in a given drawing. This does not imply that the layers and/or components not explicitly shown are omitted from the actual package structures. Moreover, the same or similar reference numbers used throughout the drawings are used to denote the same or similar features, elements, or structures, and thus, a detailed explanation of the same or similar features, elements, or structures will not be repeated for each of the drawings.

Figure 1:
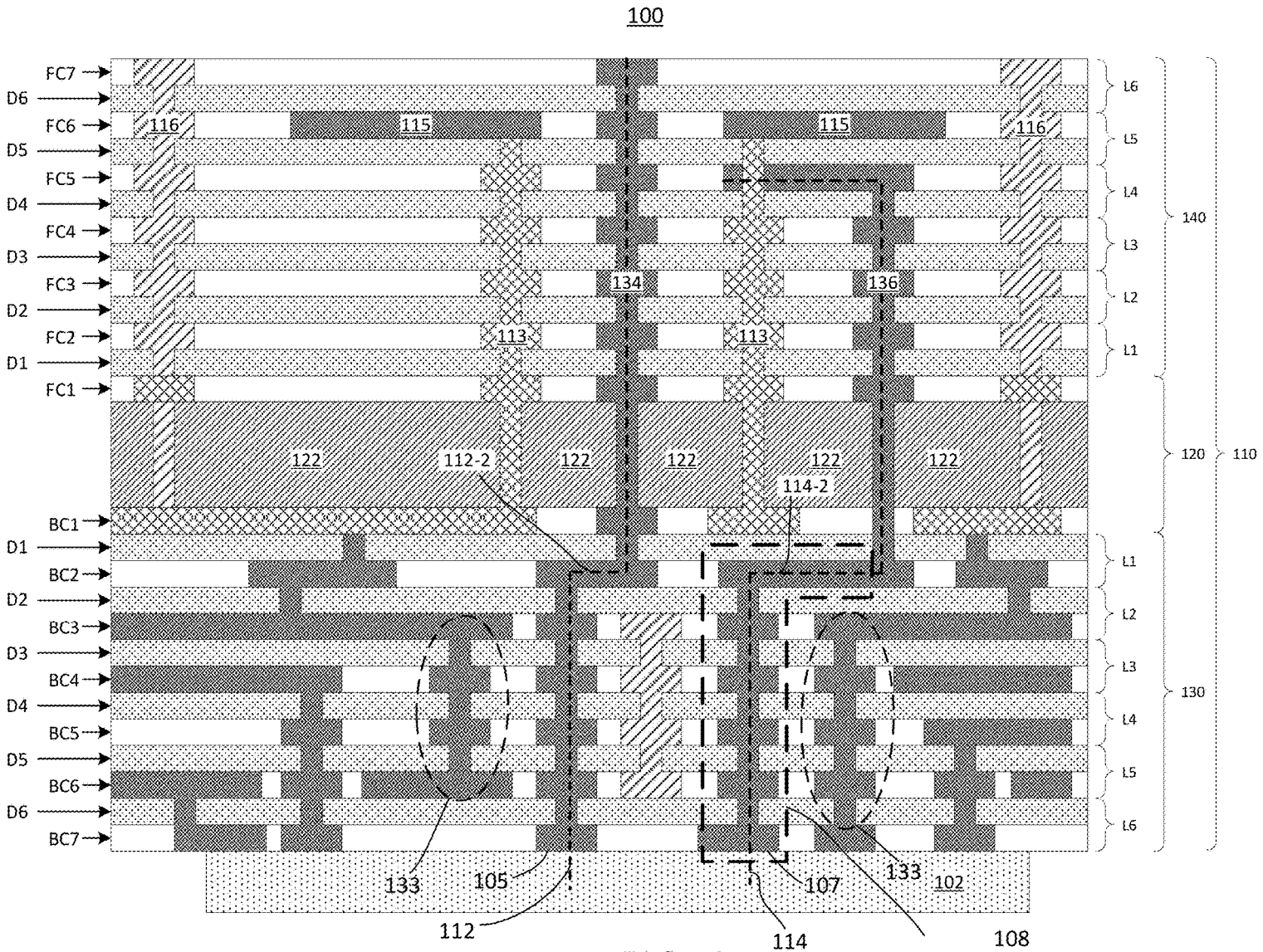
FIG. 1 is a schematic cross-sectional side view of an example of a wireless communications package, in accordance with certain embodiments.

FIG. 1 is a schematic cross-sectional side view of a wireless communications package 100 according to certain embodiments. The wireless communications package 100 comprises an RFIC chip 102, and an antenna package 110 coupled to the RFIC chip 102. The antenna package 110 comprises a multilayer package substrate comprising a central core layer 120, an interface layer 130, and an antenna layer 140.

The RFIC chip 102 comprises a metallization pattern (not specifically shown) formed on an active surface (front side) of the RFIC chip 102, which metallization pattern includes a plurality of bonding/contact pads such as, for example, ground pads, DC power supply pads, input/output pads, control signal pads, associated wiring, etc., that are formed as part of a BEOL (back end of line) wiring structure of the RFIC chip 102. The RFIC chip 102 is electrically and mechanically connected to the antenna package 110 by flip-chip mounting the active (front side) surface of the RFIC chip 102 to a second side (e.g., bottom side) of the antenna package 110 using, for example, an array of solder ball controlled collapse chip connections (C4) (not shown), or other known techniques. Depending on the application, the RFIC chip 102 comprises RFIC circuitry and electronic components formed on the active side including, for example, a receiver, a transmitter or a transceiver circuit, and other active or passive circuit elements that are commonly used to implement wireless RFIC chips. In certain embodiments, the RFIC chip 102 comprises a semiconductor substrate having an active surface and an inactive surface, and a BEOL (back end of line) structure formed on the active surface of the semiconductor substrate, wherein the RFIC chip is mounted to the package structure by connecting the BEOL structure of the RFIC chip to contact pads (not shown) of the interface structure.

In certain embodiments, as shown in FIG. 1, the antenna package 110 comprises a multilayer structure that can be constructed using known fabrication technologies such as SLC (surface laminar circuit), HDI (high density interconnect), or other fabrication techniques, which enable the formation of organic-based multilayered circuit boards with high integration density. Using these circuit board fabrication techniques, the antenna package 110 can be formed from a stack of laminated layers comprising alternating layers of metallization and dielectric/insulator materials, wherein the metallization layers are separated from overlying and/or underlying metallization layers by a respective layer of dielectric/insulating material. The metallization layers can be formed of copper and the dielectric/insulating layers can be formed of an industry standard FR4 insulating material comprised of fiberglass epoxy material. Other types of materials can be used for the metallization and insulating layers. Moreover, these technologies enable the formation of small conductive vias (e.g., partial or buried vias between adjacent metallization layers) using laser ablation, photo imaging, etching, or plating, for example, to enable the formation of high density wiring and interconnect structures within the antenna package 110.

In the embodiment of FIG. 1, the central core layer 120 provides a structurally sturdy layer upon which to build the interface layer 130 and the antenna layer 140 on opposite sides of the core layer 120. In certain examples, the core layer 120 may have a thickness of about 500-1,000 μm. In one embodiment, the core layer 120 comprises a substrate layer 122 having a first ground plane (i.e., metallization layer BC1, where BC may refer to a back conductor or a bottom conductor) formed on a bottom side of the substrate layer 122, and a second ground plane FC1 (where FC may refer to a front conductor) formed on a top side of the substrate layer 122. The substrate layer 122 can be formed of standard FR4 material, or other standard materials that are typically used to construct a standard printed circuit board. The substrate layer 122 can be formed with other materials having mechanical and electrical properties that are similar to FR4, providing a relatively rigid substrate structure that provides structural support for the antenna package 110.

The interface layer 130 comprises a plurality of laminated layers L1, L2, L3, L4, L5, L6, wherein each laminated layer L1, L2, L3, L4, L5, L6 comprises a respective patterned metallization layer BC2, BC3, BC4, BC5, BC6 and BC7 formed on a respective dielectric/insulating layer D1, D2, D3, D4, D5, D6. In certain embodiments, metallization layer BC1 is an antenna ground plane, metallization layer BC3 is a ground plane, metallization layer BC4 is a power layer, metallization layer BC5 is a low frequency (or low F) layer, and metallization layer BC6 is a ground plane. The various metallization layers may be comprised of, for example, Cu. Similarly, the antenna layer 140 comprises a plurality of laminated layers L1, L2, L3, L4, L5, L6, wherein each laminated layer L1, L2, L3, L4, L5, L6 comprises a respective patterned metallization layer FC2, FC3, FC4, FC5, FC6 and FC7 (where FC may refer to a front conductor) formed on a respective dielectric/insulating layer D1, D2, D3, D4, D5, D6, which form various components in the antenna layer 140. As also shown in FIG. 1, the metallization layer FC7 corresponds to a V-polarization feed, and the FC5 layer corresponds to a H-polarization feed. The metallization layer FC6 includes the antenna structure (i.e., the L-shaped structures 115 that are described in further detail below). In certain embodiments, for the buildup layers in the interface layer 130 and the antenna layer 140, metal plating may be used in the surface laminar circuit (SLC) process.

As noted above, in one embodiment, the laminated layers L1, L2, L3, L4, L5, L6 of the interface and antenna layers 130 and 140 can be formed using state of the art fabrication techniques such as SLC or similar technologies, which can meet the requisite tolerances and design rules needed for high-frequency applications such as millimeter-wave applications. With an SLC process, each of the laminated layers are separately formed with a patterned metallization layer, wherein the first layers L1 of the interface and antenna layers 130 and 140 are bonded to the core layer 120, and wherein the remaining laminated layers L2, L3, L4, L5 and L6 (of the respective interface and antenna layers 130 and 140) are sequentially bonded together using any suitable bonding technique, e.g., using an adhesive or epoxy material. In certain embodiments, regular PCB processes may be used where bonding materials are used. However, for SLC, HDI and LTCC, bonding materials are not used. In these situations, the laminate/dielectric is stuck together under heat/pressure directly.

As further shown in FIG. 1, conductive vias are formed through the core layer 120 and through the dielectric/insulating layers D1, D2, D3, D4, D5, D6 of the interface and antenna layers 130 and 140. The conductive vias that are formed through a given dielectric/insulating layer are connected to via pads that are pattered from the metallization layers disposed on each side of the given dielectric/insulating layer. In certain examples, a thickness of the metallization layers FC1 and BC1 may be about 36 μm or any other suitable thickness. In certain examples, a thickness of the metallization layers FC2, FC3 and FC4 may be, for example, about 15 μm or any other suitable thickness.

The various metallization layers BC1, BC2, BC3, BC4, BC5, BC6, BC7, FC1, FC2, FC3, FC4, FC5, FC6, and FC7 and vertical conductive vias are patterned and interconnected within and through the various layers (core layer 120, interface layer 130, and antenna layer 140) of the antenna package 110 to implement various features which are needed for a target wireless communications application. Such features include, for example, antenna feed lines, ground planes, RF shielding and isolation structures, power planes for routing supply power to the RFIC chip 102 (and other RFICs or chips that may be included in the wireless communications package 100), signal lines for routing IF (intermediate frequency) signals, LO (local oscillator) signals, other low frequency I/O (input/output) baseband signals, etc.

In particular, as shown in the example embodiment of FIG. 1, the antenna package 110 comprises a first antenna feed line 112 (denoted by dashed line) and a second antenna feed line (denoted by dashed line 114), which are routed through the interface layer 130, the core layer 120, and the antenna layer 140. The first and second antenna feed lines 112 and 114 comprise a series of interconnected metallic traces and conductive vias which are part of the metallization and dielectric layers of the interface layer 130, the core layer 120, and the antenna layer 140 of the antenna package 110. As shown in FIG. 1, the first and second antenna feed lines 112 and 114 are placed in between the L-shaped structures 115 (to be discussed in further detail below). Moreover, the first and second antenna feed lines 112 and 114 have no connection to the L-shaped structures 115 or the grounded cage walls 116 (to be discussed in further detail below).

In one embodiment, the first and second antenna feed lines 112 and 114 (as well as all other antenna feed lines formed within the antenna package 110) are designed to have equalized lengths to optimize antenna operation. For example, for phased array implementations, forming all antenna feed lines within the antenna package 110 to have the same or substantially the same length facilitates phase adjustment of RF signals that are fed to the patch antenna elements of the antenna array, prevents phased array beam squint, reduces angle scan error, and effectively increases the bandwidth of operation of the antenna elements.

In the example embodiment of FIG. 1, the length of the vertical portions of the antenna feed lines 112 and 114 which vertically extend though interface layer 130, the core layer 120, and the antenna layer 140, are fixed in length based on the thickness of the various layers of the antenna package 110. However, depending on the horizontal/lateral position of the L-shaped structures 115 of the antenna array relative to the corresponding antenna feed line ports (i.e., the V-port 105 and the H-port 107) of the RFIC chip 102, the lateral distance between the patch antenna elements and the RFIC chip 102 will vary. In this regard, to ensure that each antenna feed line has the same length (or substantially the same length) overall, in one embodiment, a lateral routing of the antenna feed lines 112 and 114 within the antenna package 110 is implemented with transmission lines formed in the same metallization layer of the multilayer package substrate. For example, in the embodiment shown in FIG. 1, the lengths of the antenna feed lines 112 and 114 are adjusted in the first layer L1 of the interface layer 130 by extending or shortening the routing of the lateral portions of the antenna feed lines 112 and 114 patterned from the metallization layer BC2 of the interface layer 130.

More specifically, in the embodiment of FIG. 1, horizontal portions 112-2 and 114-2 of the first and second antenna feed lines 112 and 114 are patterned from the first metallization layer BC2 of the interface layer 130. The lengths of the horizontal portions 112-2 and 114-2 of the first and second antenna feed lines 112 and 114 are either extended or shortened to compensate for the difference in the lateral and/or vertical position of the other portions of the antenna feed lines 112 and 114 which are routed through the interface layer 130, the core layer 120 and antenna layer 140.

The interface layer 130 comprises wiring to distribute power to the RFIC chip 102 and to route signals between two or more RFIC chips that are flip-chip mounted to the antenna package 110. For example, in one embodiment, the metallization layers BC4 and BC5 of the interface layer 130 serve as power planes to distribute power supply voltage to the RFIC chip 102 from an application board (not shown) using horizontal traces that are patterned on the metallization layers BC4 and BC5, and vertical via structures that are formed through the layers L4, L5, and L6 to connect the power plane metallization to contact pads on the RFIC chip 102.

In certain embodiments, the metallization layer BC6 of the interface layer 130 is patterned to form signal lines (e.g., microstrip transmission lines) for transmitting control signals, baseband signals, and other low frequency signals between an application board and the RFIC chip 102 (or between multiple RFIC chips attached to the antenna package 110). In this embodiment, the metallization layer BC7 of the interface layer 130 can serve as a ground plane for the microstrip transmission lines of the metallization layer BC6.

It is to be further noted that in the example embodiment of FIG. 1, the interface layer 130 comprises ground planes that are used for purposes of providing shielding and to provide ground elements for microstrip or stripline transmission lines, for example, that are formed by horizontal traces. For example, the metallization layer BC1 of the interface layer 120 comprises ground planes that serve as RF shields to shield the RFIC chip 102 from exposure to incident electromagnetic radiation (EM) captured by the patch antennas.

Moreover, the ground planes of the metallization layer BC1 of the interface layer 130 are configured to, e.g., (i) provide shielding between horizontal signal line traces formed in adjacent metallization layers, (ii) serve as ground planes for microstrip or stripline transmission lines, for example, that are formed by the horizontal signal line traces, and (iii) provide grounding for vertical shield structures 133 that are formed by a series of vertically connected grounded vias, which are formed through layers L3 to L6 between metallization layers BC3 and BC7, and which surround portions of the antenna feed lines 112 and 114 (e.g., vertical portions of antenna feed lines 112 and 114 adjacent to the vertical shield structures 133) extending through the interface layer 130, for example. For very high frequency applications, the implementation of stripline transmission lines and ground shielding may help to reduce interference effects of other package components such as the power plane(s), low frequency control signal lines, and other transmission lines.

In the example embodiment of FIG. 1, a combination of the vertical shield structures 133 and the vertical portions of the antenna feed lines 112 and 114 adjacent to the vertical shield structures 133 (i.e., in the interface layer 130) essentially form a transmission line structure that is similar to a coaxial transmission line, wherein the surrounding vertical shield structures 133 serve as an outer (shielding) conductor, and the vertical portions (i.e., the antenna feed lines 112 or 114) serve as a center (signal) conductor. Coaxial transmission line configurations can be implemented for other vertical portions of the antenna feed lines 112 and 114 which extend through the core layer 120 and the antenna layer 140, as schematically illustrated in FIG. 1.

Moreover, metallization layer BC7 of the interface layer 130 serves as a ground plane to isolate the antenna package 110 from the RFIC chip 102 for enhanced EM shielding. The metallization layer BC7 of the interface layer 130 comprises via openings to provide contact ports for connections between the RFIC chip 102 and package feed lines, signal lines and power lines of the antenna package 110.

As also shown in FIG. 1, the antenna layer 140 includes a grounded cage wall 116 that extends vertically through layers L1 to L6 of the antenna layer 140. The grounded cage wall 116 surrounds the L-shaped structures 115 and is connected to the L-shaped structures 115 through the metallization layer BC1 of the core layer 120. Thus, the L-shaped structures 115 are grounded planar structures that are not electrically connected to the antenna feed lines 112 and 114. Pillars 113 also connect the L-shaped structures 115 to ground. The pillars 113 extend downward from the bottom surface of the L-shaped structures 115 down to the metallization layer BC1 of the core layer 120 through layers L5-L1 and through the substrate layer 122. In one example, the pillars 113 have a vertical length of about $\lambda/4$.

Figure 2:
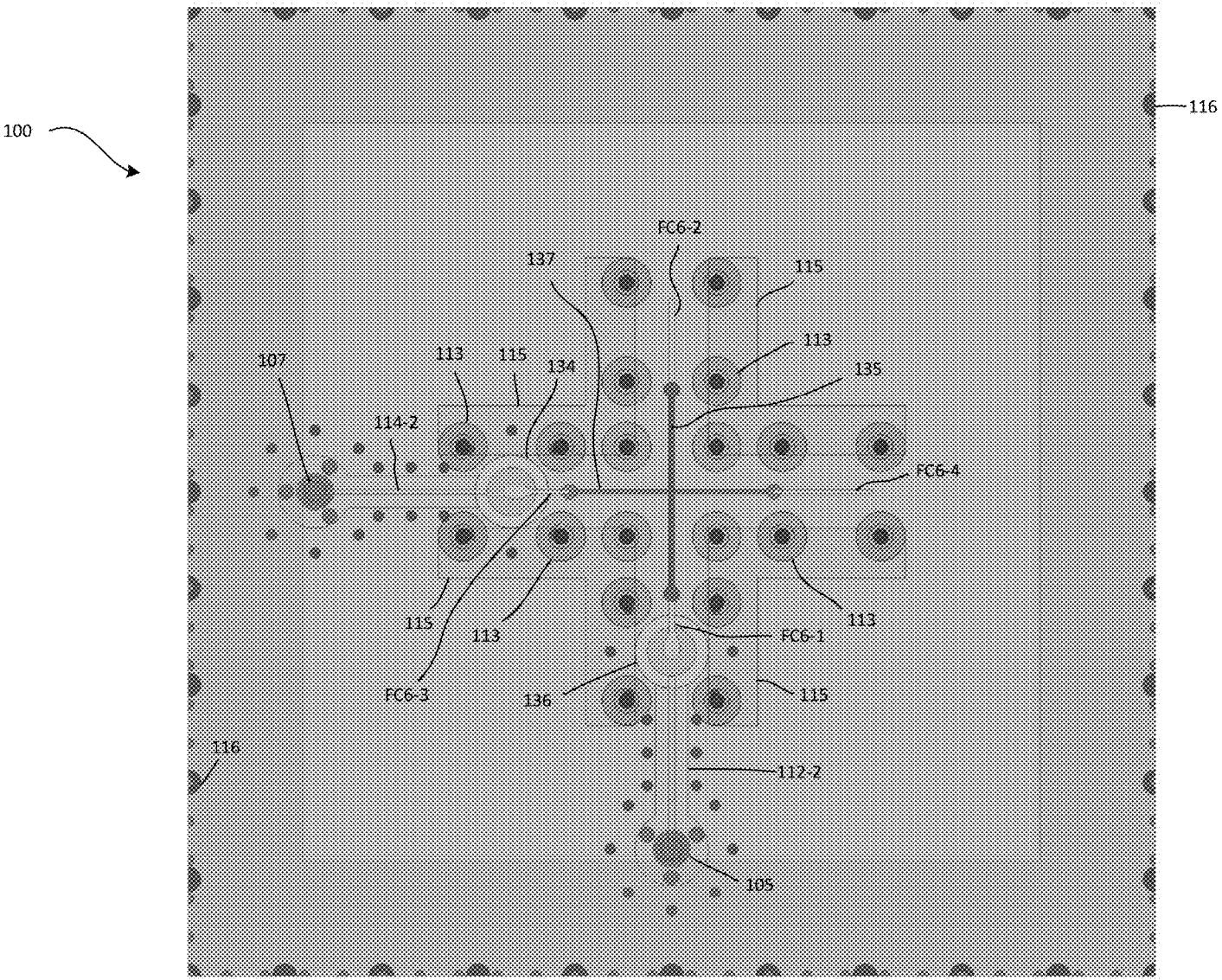
FIG. 2 is a schematic plan view of the wireless communications package of FIG. 1, in accordance with certain embodiments.

Referring now to FIG. 2, this figure shows a schematic plan view of the wireless communications package of FIG. 1, in accordance with certain embodiments. As shown in FIG. 2, the grounded cage wall 116 surrounds the entire perimeter of the wireless communications package 100. In certain embodiments, the structural elements of the grounded cage wall 116 have a semicircular shape (i.e., a half circle when viewed in plan view). Thus, as will be described in detail hereinafter, this enables a plurality of the wireless communications packages 100 to be combined into an array, and then the semicircular structural elements of the grounded cage wall 116 of adjacent packages to meet at the edges of the wireless communications package 100 to form a full circular structure.

As shown in FIG. 2, the wireless communications package 100 includes an antenna structure that includes a plurality of the L-shaped structures 115. In this example, there are four L-shaped structures 115, where the corners of each of the L-shaped structures 115 point in toward the middle of the wireless communication package 100. As discussed above with respect to FIG. 1, the pillars 113 (in this example, there are five pillars 113 associated with each L-shaped structure 115, although there may be any suitable number) extend downward from the bottom surface of the L-shaped structures 115 to the first ground plane (i.e., metallization layer BC1). As such, the pillars 113 and the metallization layer BC1 connect the L-shaped structures 115 to the grounded cage wall 116.

As shown in FIG. 2, the wireless communications package 100 includes an H-port 107 that connects to the H feed line (i.e., the second antenna feed line 114 as shown in FIG. 1) at the metallization layer BC7. The horizontal portion 114-2 of the second antenna feed line 114 is shown traversing from the H-port 107 to the center of the wireless communications package 100 (i.e., a central portion between the four L-shaped structures 115) at the level of the metallization layer BC2. At the end of the horizontal portion 114-2 of the second antenna feed line 114 closest to the center of the wireless communication package 100 is an H-structure 136 that extends vertically (as shown in the cross-section of FIG. 1) from the metallization layer BC2 to the metallization layer FC6. This is an area where a signal to the antenna is applied. For the second antenna feed line 114, there are third and fourth portions of the metallization layer FC6-3 and FC6-4 that are connected by an H-bridge 137. The H-bridge 137 is formed at metallization layer FC5.

As also shown in FIG. 2, the wireless communications package 100 includes a V-port 105 that connects to the V feed line (i.e., the first antenna feed line 112 as shown in FIG. 1) at the metallization layer BC7. The horizontal portion 112-2 of the first antenna feed line 112 is shown traversing from the V-port 105 to the center of the wireless communications package 100 at the level of the metallization layer BC2. At the end of the horizontal portion 112-2 of the first antenna feed line 112 closest to the center of the wireless communication package 100 is a V-structure 134 that extends vertically (as shown in the cross-section of FIG. 1) from the metallization layer BC2 to the metallization layer FC6. This is also an area where an antenna signal is applied. For the first antenna feed line 112, there are first and second portions of the metallization layer FC6-1 and FC6-2 that are connected by a V-bridge 135. The V-bridge 135 (or a second bridge) is formed at metallization layer FC7. It should be appreciated that because the V-bridge 135 is formed at metallization layer FC7 and the H-bridge 137 (or a first bridge) is formed at metallization layer FC5 that they are different heights. Thus, when they cross in the middle of the wireless communications package (i.e., in the plan view of FIG. 2) they do not contact each other. In other words, the V-bridge 135 crosses over the H-bridge 137. In particular, for the V-bridge 135 to avoid crossing bridges (i.e., for avoiding H and V feeds crossing each other on FC6 layer), the H-bridge 137 has a section on metallization layer FC6, goes down to metallization layer FC5 for a section, then goes up to metallization layer FC6 for another section. The V-bridge 135 has section on metallization layer FC6, goes up to metallization layer FC7 for a section, then goes down to metallization layer FC6 for another section. Moreover, it should also be appreciated that the L-shaped structures 115 are at the same metallization layer level (i.e., metallization layer FC6) as the first, second, third and fourth portions of the metallization layer FC6-1, FC6-2, FC6-3, and FC6-4.

Figure 3:
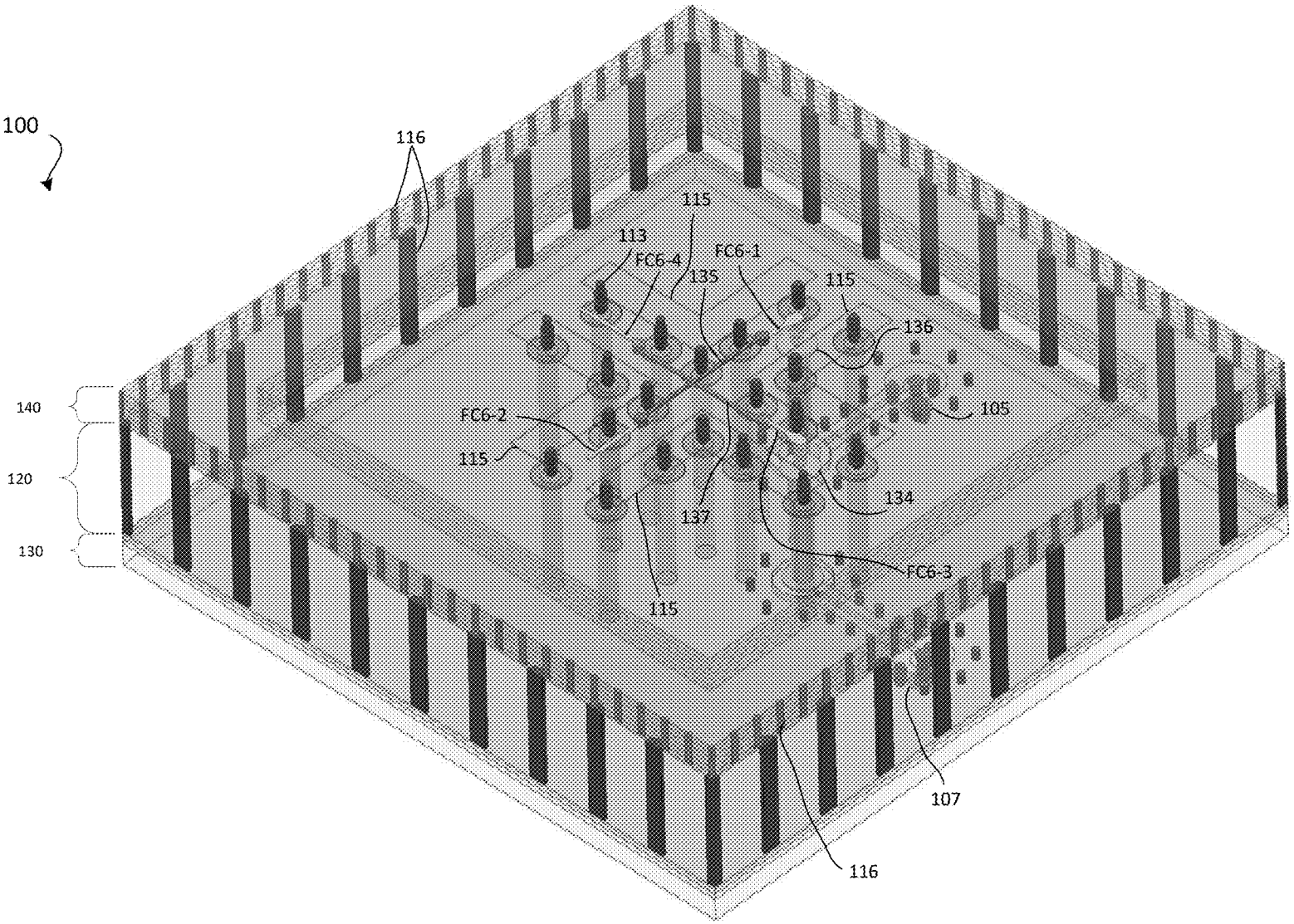
FIG. 3 is perspective view of the wireless communications package of FIG. 1, in accordance with certain embodiments.

Referring now to FIG. 3, this figure shows a schematic plan view of the wireless communications package of FIG. 1, in accordance with certain embodiments. The elements in FIG. 3 correspond to like elements in FIG. 2, and thus the description of same will not be repeated herein. However, as shown in FIG. 3, in certain examples, the conductive portions of the grounded cage wall 116 in the central core layer 120 may have a larger diameter than the portions in the antenna layer 140. Also, the number of conductive portions of the grounded cage wall 116 in the antenna layer 140 may be greater than the number of conductive portions in the core layer 120, as shown in FIG. 3. This feature can also be seen in the plan view of FIG. 2. It should be appreciated however than any other suitable diameter or number of conductive portions may be used for the grounded cage wall 116.

Figure 4:
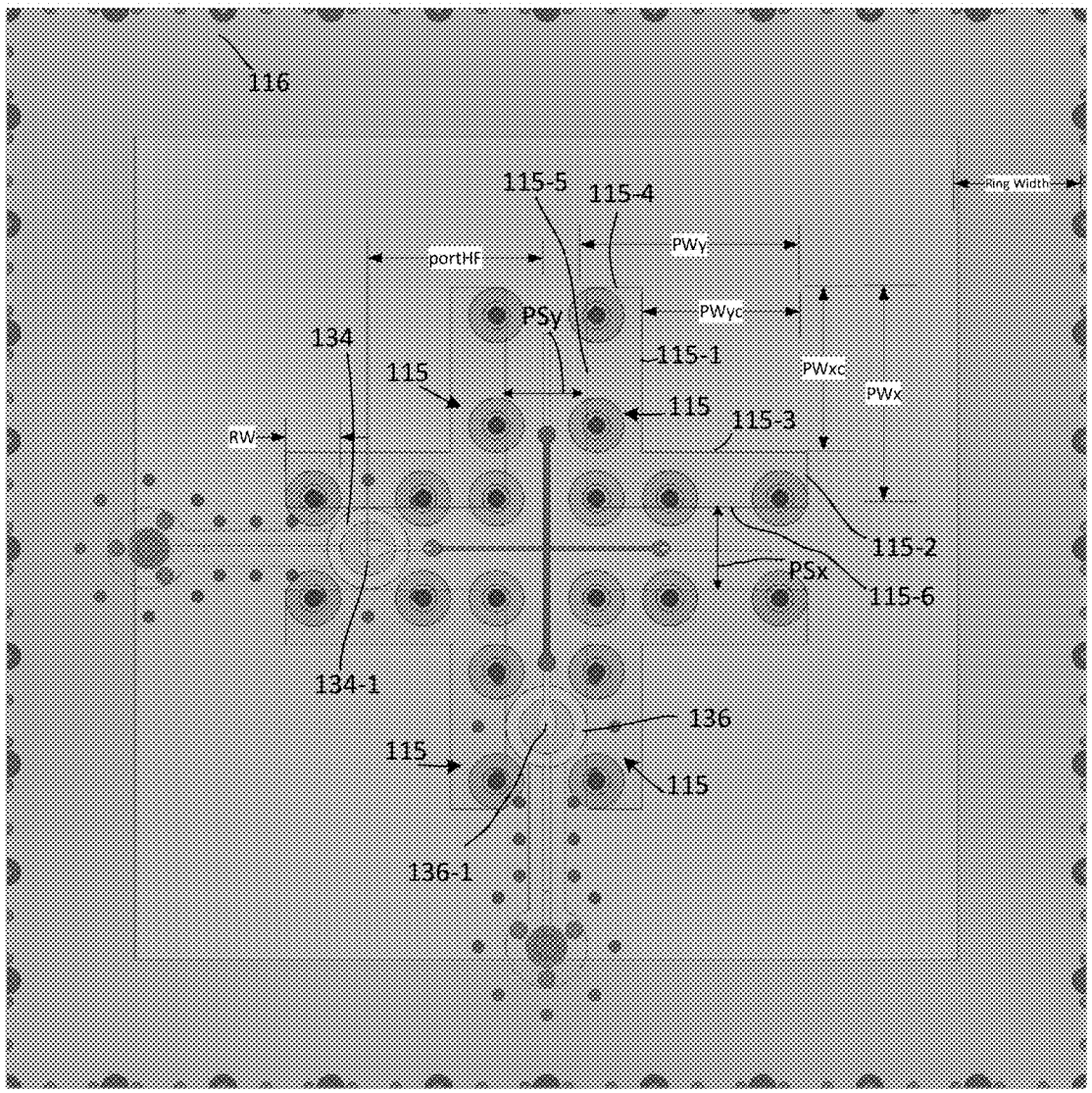
FIG. 4 is a schematic plan view of the wireless communications package of FIG. 1 showing illustrating certain principles of operation of the device, in accordance with certain embodiments.

Referring now to FIG. 4, this figure shows a schematic plan view of the wireless communications package 100 of FIG. 1 showing illustrating certain principles of operation of the device, in accordance with certain embodiments. As shown in FIG. 4, depending on the dimensions, the antenna structure can have one or two resonant frequencies. In the case of two resonant frequencies, the high resonant frequency is primarily determined by the height or the vertical distance between metallization layer FC6 and metallization layer BC1 and the substrate layer 122 and buildup layer dielectric constants. The low resonant frequency is determined by the parameters of PWxc (i.e., a distance between a third side 115-3 and a fourth side 115-4 of the L-shaped structure 115) and PWyc (i.e., a distance between a first side 115-1 and a second side 115-2 of the L-shaped structure 115) (assuming PWx and Pwy are fixed). Decreasing the values of these parameters will decrease the low resonant frequency. It also pushes the high resonant frequency a little bit higher. As a result, the antenna bandwidth widens.

The low resonant frequency is also determined by the parameters of PWx (i.e., a distance between a sixth side 115-6 and a fourth side 115-4 of the L-shaped structure 115) and Pwy (i.e., a distance between a fifth side 115-5 and a second side 115-2 of the L-shaped structure 115). Increasing the values of these parameters will decrease the low resonant frequency. It also pushes the high resonant frequency a little bit lower. Another geometrical parameter that may exist is portHF, which is shown in FIG. 4. Another geometrical parameter than may exist is the Ring Width, which is indicated on FIG. 4, which represents the width of the grounded cage wall 116 zone.

Bandwidth and impedance match may also need to be optimized by changing one or more of the parameters (i.e., PWx, PWy, PWyc, PWxc, portHF, and the Ring Width) shown in FIG. 4. The reflection coefficient curves (see, FIG. 6, S11 and S22) have a "W" shape. Widening the bandwidth implies that the center tip of the "W" moves up. The grounded ring width RW of the pillars 113 may also affect the antenna performance it is too wide. The grounded ring of the pillars 113 not only can enhance antenna performance but may also be required in certain high precision package processes. Therefore, the grounded ring of the pillars 113 may also be considered to be a part of the antenna structure of the wireless communication package 100, according to certain embodiments.

Figure 5:
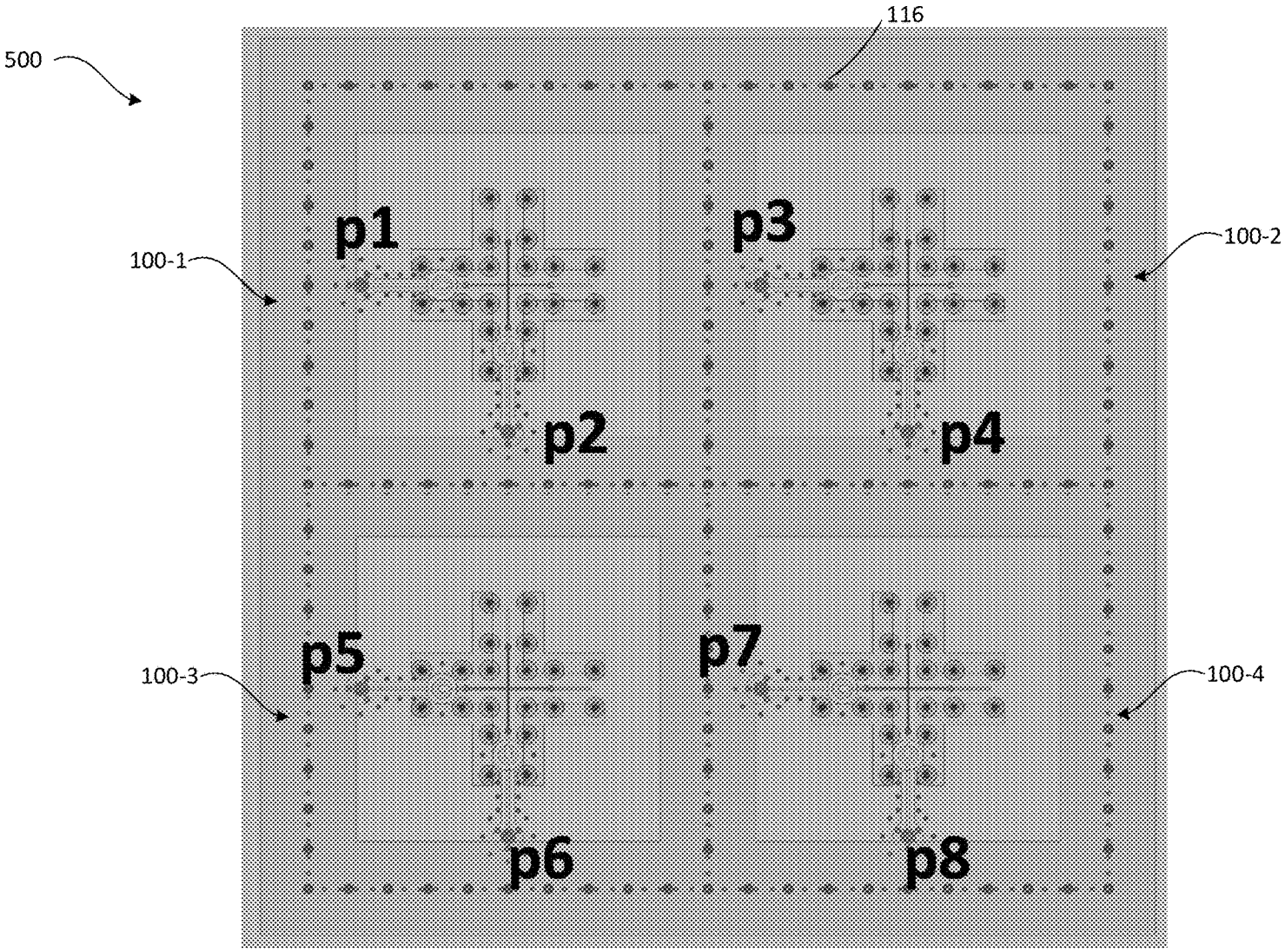
FIG. 5 is a schematic plan view of an array of the wireless communications packages of FIG. 1, in accordance with certain embodiments.

Referring now to FIG. 5, this figure is a schematic plan view of an array of the wireless communications packages 100 of FIG. 1, in accordance with certain embodiments. In this example, there is a two-by-two array of wireless communications packages 100-1, 100-2, 100-3 and 100-4. As discussed briefly above with respect to FIG. 2, in certain embodiments, the structural elements of the grounded cage wall 116 have a semicircular shape (i.e., a half circle when viewed in plan view). Thus, this enables a plurality of the wireless communications packages 100-1, 100-2, 100-3 and 100-4 to be combined into an array, and then the semicircular structural elements of the grounded cage wall 116 of adjacent packages to meet at the edges of the wireless communications package 100 to form a full circular structure. As such, the grounded cage walls 116 (or grounded cage structures) may be abutted to each other. The effects of this may include: (1) the grounded cage walls 116 may help to satisfy metal density requirements; (2) it may provide isolation between the antenna structures of the different wireless communication packages 100-1, 100-2, 100-3 and 100-4; and (3) it may help with scalability. Although a two-by-two array is shown with respect to FIG. 5, it should be appreciated that any suitably sized array may be used (e.g., and eight-by-eight array of sixty four antennas). In certain examples, the spacing between respective centers of different antennas in the array of adjacent wireless communication packages 100 may be a $\lambda/2$ wavelength. It should also be appreciated that the underlying RFIC chip 102 is shown to correspond with one of the wireless communications packages (e.g., as shown in FIG. 1). It should also be appreciated that the grounded cage walls 116 may help in isolating the antennas in different wireless communications packages 100 in the array. The grounded cage walls 116 may also aide in the manufacturing process, and they may reduce antenna bandwidth and detune the impedance matching. Also, by adjusting the dimensions of the L-shaped structures 115, the antenna bandwidth and impedance matching may also be improved.

Figure 6:
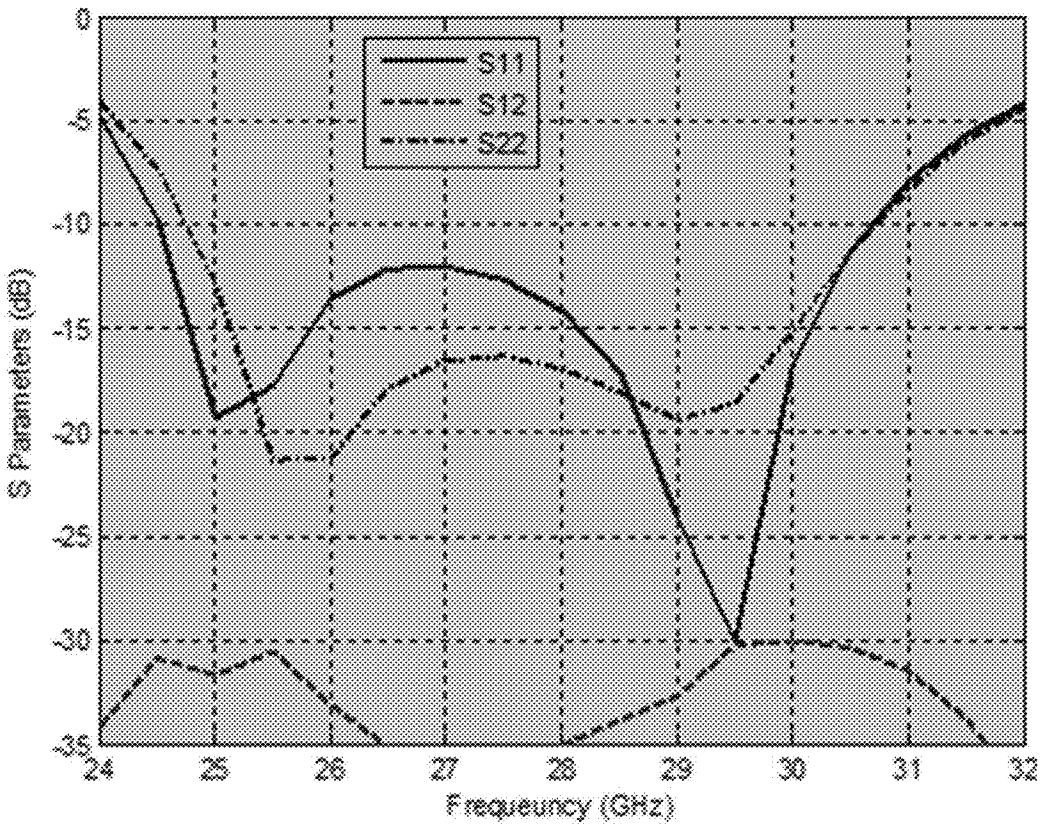
FIG. 6 is a graph depicting antenna impedance matching and port coupling for a wireless communications package, in accordance with certain embodiments.

FIG. 6 is a graph depicting antenna impedance matching and port coupling for a wireless communications package, in accordance with certain embodiments. As discussed above, the antenna bandwidth and impedance match may also need to be optimized by changing one or more of the parameters (i.e., PWx, PWy, PWyc, PWxc, portHF, and the Ring Width) shown in FIG. 4. The reflection coefficient curves (see, FIG. 6, S11 and S22) have a "W" shape. Widening the bandwidth implies that the center tip of the "W" moves up. In certain examples, the layout of the L-shaped structures 115 is in a symmetrical configuration, where the dimensions of PSy and PSx are the same, where the dimensions of PWyc and PWxc are the same, and where the dimensions of PWy and PWx are the same.

Figure 7:
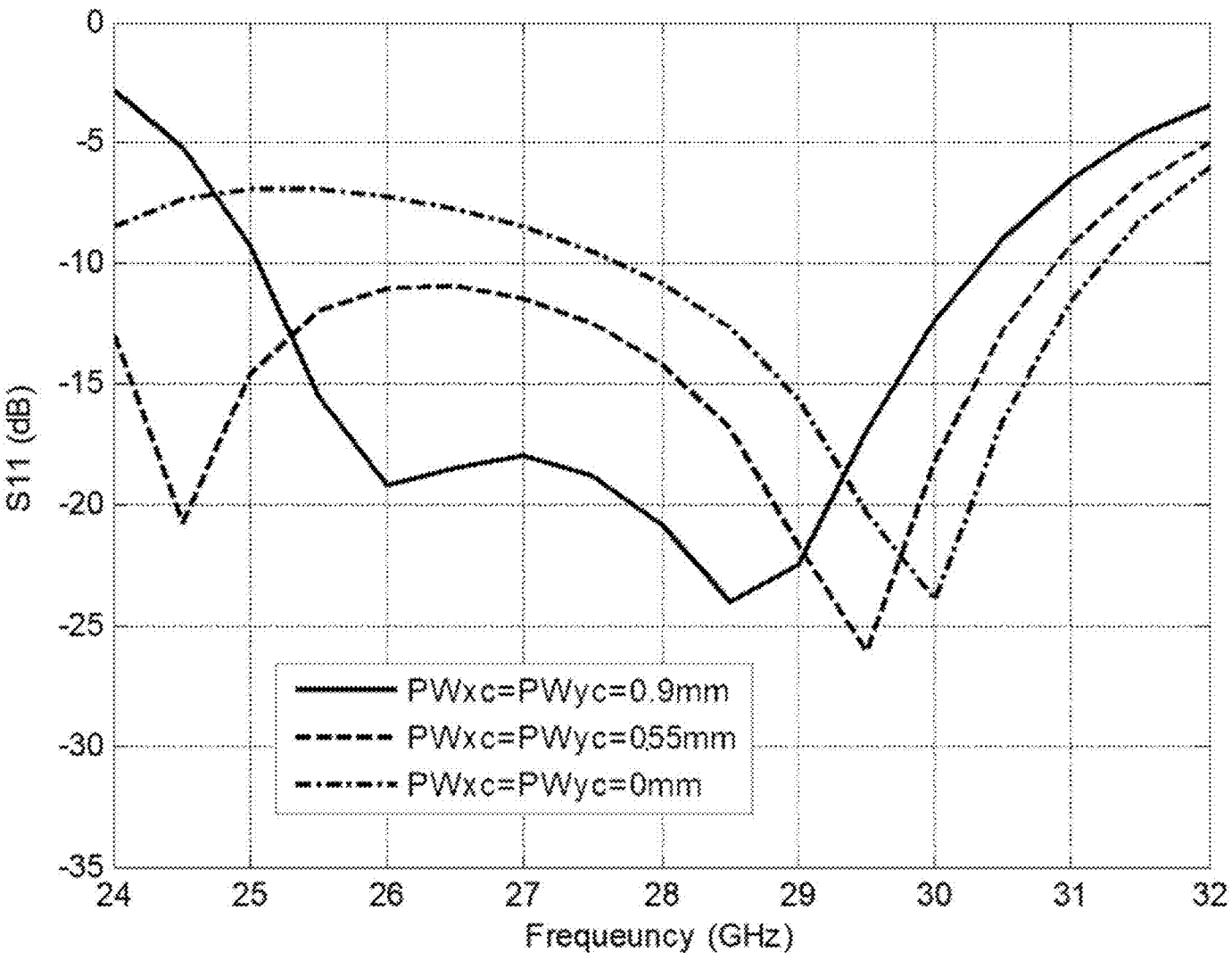
FIG. 7 is a graph depicting antenna frequencies for several different wireless communications packages, each having a different geometry, in accordance with certain embodiments.

FIG. 7 is a graph depicting antenna frequencies for several different wireless communications packages 100, each having a different geometry, in accordance with certain embodiments. In particular, FIG. 7 shows a simulated performance comparison when the geometry of the L-shaped structures 115 discussed herein are changed between the actual L-shape shown in FIG. 2 to more of standard square shaped patch. If PWxc=PWyc=0, the L-shaped structures become square patches (see also, FIG. 4). Reducing PWxc and PWyc will widen the antenna bandwidth (moving the two resonant frequencies apart). Changing PWx and PWy could also move the two resonant frequencies. In certain embodiments, by adjusting PWx, PWy, PWxc, and PWyc, antenna performance can be optimized. Moreover, changing the PWxc and PWyc parameters may provide additional design freedom. As shown in FIG. 7, the curves PWxc=PWyc=0.55 mm and PWxc=PWyc=0.90 mm have a "W" shape, that allows for two resonant frequencies. Also, with these two curves having the "W" shape, it can be seen that curve PWxc=PWyc=0.90 mm has a narrower bandwidth (i.e., the horizontal distance between the two bottom points of the "W") than curve PWxc=PWyc=0.55 mm. Thus, it can be seen that the antenna performance characteristics may be tuned or optimized by changing the physical dimensions of the L-shaped structures 115.

Figure 8:
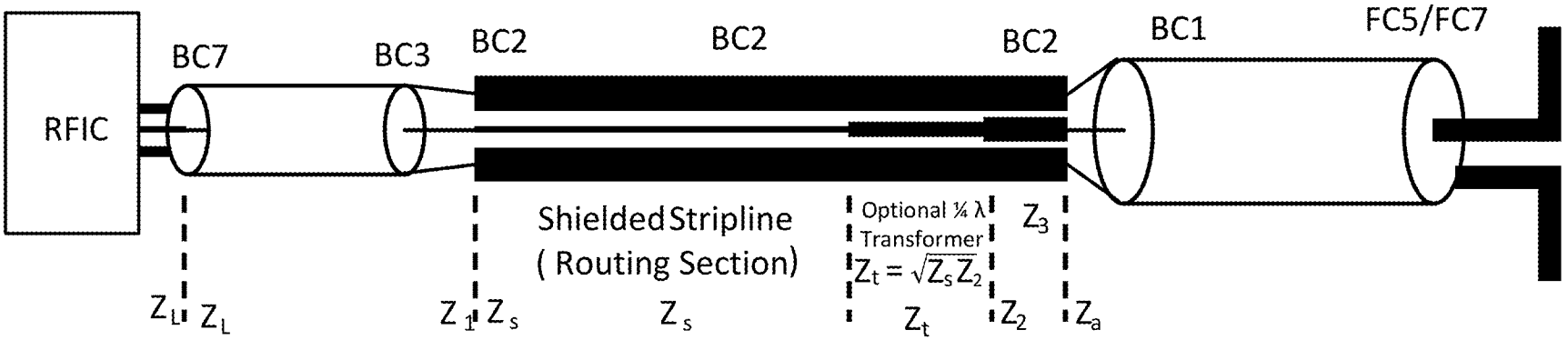
FIG. 8 is a schematic diagram illustrating a feedline design for impedance matching and routing for a wireless communication package, in accordance with certain embodiments.

FIG. 8 is a schematic diagram illustrating a feedline design for impedance matching and routing for a wireless communication package, in accordance with certain embodiments. In general, antenna impedance at the bottom of the antenna ground plane at metallization layer BC1 is not matched to the RFIC transceiver impedance ZL (typically 50 ohm) at metallization layer BC7. The vertical transition from metallization layer BC7 to metallization layer BC3 will transform impedance from ZL to Z1. In the array design, antennas will have difference distances to the transceiver ports. Since antenna feed lines need to routine in the antenna package design, it may be needed to set Z1=Zs, so that changing the routing line length will not affect the impedance at the transceiver ports. In the case that adjusting the length and width of line section with impedance Z3 cannot ensure that Zs=Z2, a quarter wavelength transformer with line impedance Zt may be required.

Those of ordinary skill in the art will readily appreciate the various effect associated with integrated chip/antenna package structures according to the present embodiments. For instance, the package structure can be readily fabricated using known manufacturing and packaging techniques to fabricate and package antenna structures with semiconductor RFIC chips to form compact integrated radio/wireless communications systems that are configured to operate at millimeter-wave frequencies and higher. Moreover, integrated chip packages according to embodiments enable antennas to be integrally packaged with IC chips such as transceiver chips, which provide compact designs with very low loss between the transceiver and the antenna. Moreover, the use of integrated antenna/IC chip packages according to embodiments as discussed herein saves significant space, size, cost, and weight, which is a premium for virtually any commercial or military application.

It is to be understood that the present embodiments will be described in terms of a given illustrative architecture; however, other architectures, structures, substrate materials and process steps/blocks can be varied within the scope of the present disclosure. It should be noted that certain features cannot be shown in all figures for the sake of clarity. This is not intended to be interpreted as a limitation of any particular embodiment, or illustration, or scope of the claims.

It will also be understood that when an element such as a layer, region or substrate is referred to as being "on" or "over" another element, it can be directly on the other element or intervening elements can also be present. In contrast, when an element is referred to as being "directly on" or "directly over" another element, there are no intervening elements present. It will also be understood that when an element is referred to as being "connected" or "coupled" to another element, it can be directly connected or coupled to the other element or intervening elements can be present. In contrast, when an element is referred to as being "directly connected" or "directly coupled" to another element, there are no intervening elements present.

Reference in the specification to "one embodiment" or "an embodiment", as well as other variations thereof, means that a particular feature, structure, characteristic, and so forth described in connection with the embodiment is included in at least one embodiment. Thus, the appearances of the phrase "in one embodiment" or "in an embodiment", as well any other variations, appearing in various places throughout the specification are not necessarily all referring to the same embodiment.

It is to be appreciated that the use of any of the following "/", "and/or", and "at least one of", for example, in the cases of "A/B", "A and/or B" and "at least one of A and B", is intended to encompass the selection of the first listed option (A) only, or the selection of the second listed option (B) only, or the selection of both options (A and B). As a further example, in the cases of "A, B, and/or C" and "at least one of A, B, and C", such phrasing is intended to encompass the selection of the first listed option (A) only, or the selection of the second listed option (B) only, or the selection of the third listed option (C) only, or the selection of the first and the second listed options (A and B) only, or the selection of the first and third listed options (A and C) only, or the selection of the second and third listed options (B and C) only, or the selection of all three options (A and B and C). This can be extended, as readily apparent by one of ordinary skill in this and related arts, for as many items listed.

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Spatially relative terms, such as "beneath," "below," "lower," "above," "upper," and the like, can be used herein for ease of description to describe one element's or feature's relationship to another element(s) or feature(s) as illustrated in the FIG. It will be understood that the spatially relative terms are intended to encompass different orientations of the device in use or operation in addition to the orientation depicted in the FIGS. For example, if the device in the FIGS. is turned over, elements described as "below" or "beneath" other elements or features would then be oriented "above" the other elements or features. Thus, the term "below" can encompass both an orientation of above and below. The device can be otherwise oriented (rotated 90 degrees or at other orientations), and the spatially relative descriptors used herein can be interpreted accordingly. In addition, it will also be understood that when a layer is referred to as being "between" two layers, it can be the only layer between the two layers, or one or more intervening layers can also be present.

It will be understood that, although the terms first, second, etc. can be used herein to describe various elements, these elements should not be limited by these terms. These terms are only used to distinguish one element from another element. Thus, a first element discussed below could be termed a second element without departing from the scope of the present concept.

The descriptions of the various embodiments have been presented for purposes of illustration and are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A package structure, comprising:

a planar core structure comprising a first side and a second side opposite the first side;

an antenna structure disposed on the first side of the planar core structure, the antenna structure comprising a plurality of first laminated layers, each first laminated layer comprising a first patterned conductive layer formed on a first insulating layer, an antenna formed on one or more first patterned conductive layers of the first laminated layers, the antenna including at least one L-shaped structure as viewed in a plan view;

an interface structure disposed on the second side of the planar core structure; and an antenna feed line structure formed in, and routed through, the interface structure and the planar core structure, wherein the antenna feed line structure is not connected to the antenna.

2. The package structure of claim 1, wherein the planar core structure comprises a core substrate formed of an insulating material.

3. The package structure of claim 1, wherein the interface structure comprises a plurality of second laminated layers, each second laminated layer comprising a second patterned conductive layer formed on a second insulating layer.

4. The package structure of claim 1, wherein the interface structure comprises a plurality of second laminated layers, each second laminated layer including a second patterned conductive layer formed on a second insulating layer, and wherein a power plane, a ground plane, signal lines, and contact pads are formed on one or more patterned second conductive layers of the plurality of second laminated layers of the interface structure.

5. The package structure of claim 1, wherein the antenna includes four of the L-shaped structures.

6. The package structure of claim 5, wherein the L-shaped structures are arranged in a symmetrical manner with corners of the L-shaped structures facing inward.

7. The package structure of claim 1, further comprising a cage wall structure in the antenna structure, the cage wall surrounding the antenna.

8. The package structure of claim 7, wherein the cage wall structure is electrically connected to the L-shaped structure through a first ground plane layer of the core structure.

9. The package structure of claim 7, wherein the cage wall structure includes a plurality of conductive grounded rings that extend vertically through the antenna structure.

10. The package structure of claim 1, further comprising:

a first antenna feed line structure and a second antenna feed line structure;

a first bridge formed on one of the one or more first patterned conductive layers and connected to the first antenna feed line structure; and a second bridge formed on a different one of the one or more first patterned conductive layers and connected to the second antenna feed line structure, wherein the first bridge and second bridge cross each other in a central portion of the package structure.

11. An apparatus, comprising:

a package structure comprising a planar core structure comprising a first side and a second side opposite the first side, an antenna structure disposed on the first side of the planar core structure, the antenna structure comprising a plurality of first laminated layers, each first laminated layer comprising a first patterned conductive layer formed on a first insulating layer, an antenna formed on one or more first patterned conductive layers of the first laminated layers, the antenna including at least one L-shaped structure as viewed in a plan view, an interface structure disposed on the second side of the planar core structure, and an antenna feed line structure formed in, and routed through, the interface structure and the planar core structure, wherein the antenna feed line structure is not connected to the antenna; and an RFIC (radio frequency integrated circuit) chip comprising a semiconductor substrate having an active surface and an inactive surface, and a BEOL (back end of line) structure formed on the active surface of the semiconductor substrate, wherein the RFIC chip is mounted to the package structure by connecting the BEOL structure of the RFIC chip to contact pads of the interface structure.

12. The apparatus of claim 11, wherein the planar core structure comprises a core substrate formed of an insulating material.

13. The apparatus of claim 11, wherein the interface structure comprises a plurality of second laminated layers, each second laminated layer comprising a second patterned conductive layer formed on a second insulating layer.

14. The apparatus of claim 11, wherein the interface structure comprises a plurality of second laminated layers, each second laminated layer including a second patterned conductive layer formed on a second insulating layer, and wherein a power plane, a ground plane, signal lines, and contact pads are formed on one or more patterned second conductive layers of the plurality of second laminated layers of the interface structure.

15. The apparatus of claim 11, wherein the antenna includes four of the L-shaped structures.

16. The apparatus of claim 15, wherein the L-shaped structures are arranged in a symmetrical manner with corners of the L-shaped structures facing inward.

17. The apparatus of claim 11, further comprising a cage wall structure in the antenna structure, the cage wall surrounding the antenna.

18. The apparatus of claim 17, wherein the cage wall structure is electrically connected to the L-shaped structure through a first ground plane layer of the core structure.

19. The apparatus of claim 17, wherein the cage wall structure includes a plurality of conductive grounded rings that extend vertically through the antenna structure.

20. The apparatus of claim 11, further comprising:

a first antenna feed line structure and a second antenna feed line structure;

a first bridge formed on one of the one or more first patterned conductive layers and connected to the first antenna feed line structure; and a second bridge formed on a different one of the one or more first patterned conductive layers and connected to the second antenna feed line structure, wherein the first bridge and second bridge cross each other in a central portion of the package structure.

21. A method of manufacturing a package structure, the method comprising:

forming a planar core structure comprising a first side and a second side opposite the first side;

forming an antenna structure on the first side of the planar core structure, the antenna structure comprising a plurality of first laminated layers, each first laminated layer comprising a first patterned conductive layer formed on a first insulating layer, an antenna formed on one or more first patterned conductive layers of the first laminated layers, the antenna including at least one L-shaped structure as viewed in a plan view;

forming an interface structure on the second side of the planar core structure; and forming an antenna feed line structure in, and routed through, the interface structure and the planar core structure, wherein the antenna feed line structure is not connected to the antenna.

22. The method of claim 21, wherein the antenna includes four of the L-shaped structures.

23. The method of claim 22, wherein the L-shaped structures are arranged in a symmetrical manner with corners of the L-shaped structures facing inward.

24. The method of claim 21, further comprising forming a cage wall structure in the antenna structure, the cage wall surrounding the antenna.

25. The method of claim 24, wherein the cage wall structure is electrically connected to the L-shaped structure through a first ground plane layer of the core structure.

* * * * *